United States Patent [19]

Nixon

[11] Patent Number: 4,834,392

[45] Date of Patent: May 30, 1989

[54] COURT GAME AND APPARATUS THEREFORE

[76] Inventor: Robert W. Nixon, 7700 N. Kings Hwy., Myrtle Beach, S.C. 29577

[21] Appl. No.: 95,101

[22] Filed: Sep. 10, 1987

[51] Int. Cl.[4] ..... A63B 71/04

[52] U.S. Cl. ..... 273/411

[58] Field of Search ..... 273/411, 29 R, 29 B, 273/30, 31

[56] References Cited

U.S. PATENT DOCUMENTS

| | | | |
|---|---|---|---|
| 1,699,660 | 1/1929 | Forrest | 273/29 R |
| 3,393,913 | 7/1968 | Safina | 273/411 X |
| 3,968,968 | 7/1976 | Peterson | 273/411 |
| 4,045,022 | 8/1977 | Grant et al. | 273/29 R |
| 4,054,987 | 10/1977 | Forlenza | 273/29 R X |
| 4,062,541 | 12/1977 | Marks | 273/67 R X |
| 4,128,239 | 12/1978 | Grenadier | 273/67 R |
| 4,336,942 | 6/1982 | Warehime | 273/411 |
| 4,355,813 | 10/1982 | Rathjen | 273/411 |
| 4,457,513 | 7/1984 | Thompson | 273/411 |
| 4,482,157 | 11/1984 | McNeil | 273/411 |

FOREIGN PATENT DOCUMENTS

| | | | |
|---|---|---|---|
| 599727 | 3/1948 | United Kingdom | 273/411 |

OTHER PUBLICATIONS

*Kick the Can,* by Darwin A. Hindman, Title, Reverse Title, Contents pages, and pp. 249, 250 and 278–280.

Flaghouse Wholesale Catalog of . . . Recreations . . . Supplies, p. 20, Winter 1980–1981.

Squires, D., "The Other Racquet Sports", (McGraw-Hill Book Company, New York, New York) (1978), pp. 198–239.

*Primary Examiner*—William H. Grieb

*Attorney, Agent, or Firm*—Bell, Seltzer, Park & Gibson

[57] ABSTRACT

A court game apparatus, game method and playing court is disclosed. The apparatus comprises a small resilient ball, at least two paddles having a solid, substantially rigid striking surface, and a playing court. The playing court comprises a rectangular main court having opposite sides and opposite ends defining side and end boundaries, respectively, and foul detector means extending from one side of the playing court to the other midway between the end boundaries and dividing the main court into two opposing playing zones of equal size. Each of the playing zones is of a size sufficient to accommodate at least one player equipped with one of the paddles. In a preferred embodiment of the invention, the foul detector means is a rectangular foul zone. Preferred dimensions for a singles court of the present invention are about fifteen (15) feet wide by about thirty (30) feet long with a foul zone about four (4) feet wide. A preferred doubles court is about an additional five (5) feet wider.

11 Claims, 2 Drawing Sheets

COURT GAME AND APPARATUS THEREFORE

FIELD OF THE INVENTION

The present invention relates to court games generally, and particularly relates to a court game which provides the "feel" of racquet ball without the need for and expensive court.

BACKGROUND OF THE INVENTION

Numerous types of court games are currently available. These games differ in the amount of exercise derived from playing the game, the level of skill and coordination required to play the game, and the. overall "feel" the game has to those playing the game. Exemplary court games include squash, racquet ball, tennis, paddle ball and table tennis ("Ping-Pong").

The game of racquet ball has become increasingly popular. It offers an exercise factor suitable to many people, does not require an inordinate amount of coordination, can be quickly learned and has a "feel" which many players find exciting. For more experienced players, the game is sufficiently challenging to reward practice with increased skill, so the game does not become monotonous. Unfortunately, court construction costs for racquetball are high, and the game is generally played only at clubs which charge a membership fee commensurate with the cost of their facilities.

Accordingly, an object of the present invention is to provide a court game with the "feel" and excitement of racquet ball, yet which can be played on an inexpensive court.

More particular objects of the present invention are to provide a game which is moderately strenuous, can be quickly learned, requires an average level of coordination to play, and rewards those who invest time in learning and playing the game with greater skill and improved performance.

SUMMARY OF THE INVENTION

The foregoing and other objects and advantages are achieved with the court game and apparatus therefor disclosed below. The apparatus comprises a small resilient ball, at least two paddles having a solid, relatively rigid striking surface, and a playing court. The playing court comprises a rectangular main court having opposite sides and opposite ends defining side and end boundaries, respectively, and foul detector means extending from one side of the playing court to the other midway between the end boundaries and dividing the main court into two opposing playing zones of equal size. Each of said playing zones is of a size sufficient to accommodate at least one player equipped with one of the paddles. Players can serve and return the ball to and from one another by striking the ball with the paddle, while seeking to avoid striking the ball into the foul detection means.

Also disclosed herein is a method of playing a ball type court game among at least two players. In the method, a rectangular main court is designated, which court has opposite sides and opposite ends defining side and end boundaries, respectively. Foul detection means are provided, which detection means extend from one side of the playing curt to the other midway between the end boundaries and divide the main court into two opposing playing zones of equal size. At least one player is positioned in each of the playing zones, each player is equipped with a paddle having a solid, relatively rigid striking surface, and one of the players is equipped with a small resilient ball. A set of rules is provided, and the players are permitted to play a game involving the serving and returning of the ball with the paddles in accordance with the rules provided.

In a preferred embodiment of the foregoing method, the game is commenced by the player equipped with the ball serving the ball to the opposing playing zone with the paddle. The game is continued by respective players in each opposing playing zone alternately returning the ball to the opposing playing zone with the paddle. The game is scored by detecting the ball landing outside the side and end boundaries, by detecting the ball striking the foul detection means, and by detecting the ball bouncing twice within one of the playing zones before being returned by the player positioned in that playing zone.

BRIEF DESCRIPTION OF THE DRAWINGS

The foregoing will be explained in detail in the following description and drawings, in which.

DETAILED DESCRIPTION OF THE INVENTION

Figure 1:
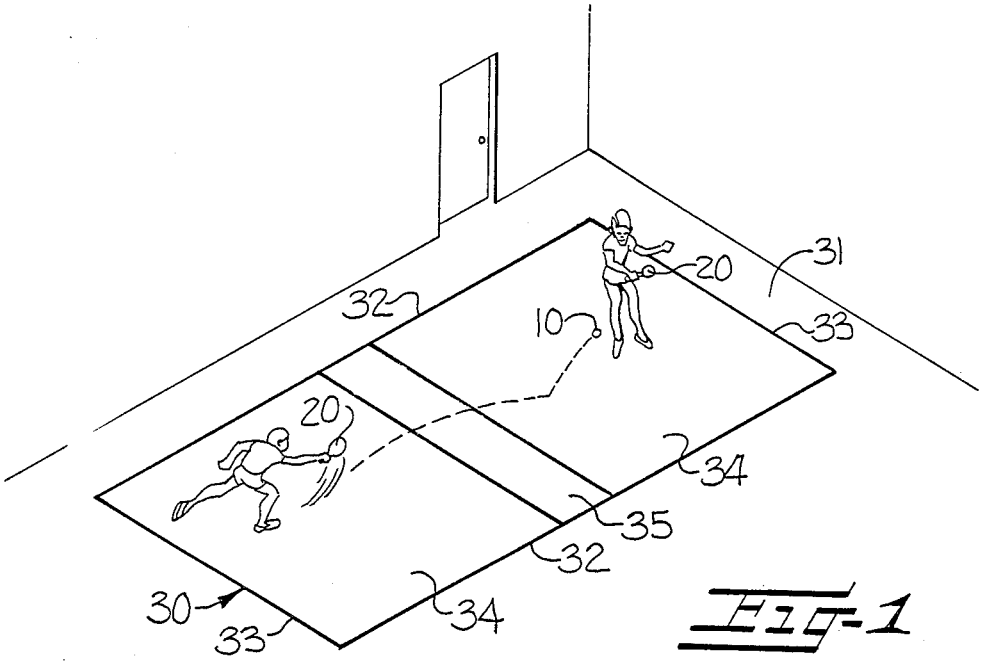
FIG. 1 is a perspective view of one embodiment of an apparatus of the present invention, adapted for use by two opposing players.
Figure 2:
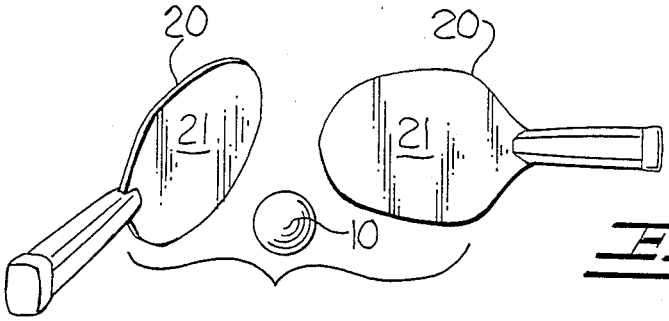
FIG. 2 is a perspective view of a pair of paddles and a resilient ball useful in the present invention.

As illustrated in FIGS. 1 and 2, the apparatus of the present invention comprises a small resilient ball 10, at least two paddles 20 having a solid, substantially rigid striking surface 21, and a playing court 30.

The ball 10, preferably, is a racquetball ball, though any small resilient ball is suitable. The solid, substantially rigid striking surface 21 on the paddle is in contrast to the string or net striking surface of a tennis racquet, which would tend to launch the ball for too great a distance to be useful in the present invention. The paddle striking surface may, however, be either perforated or unperforated. Exemplary constructions for paddles useful in practicing the present invention are disclosed in U.S. Pat. Nos. 4,128,239 and 4,062,541, the disclosures of which are incorporated herein by reference. Paddle ball paddles are particularly suitable.

Figure 3:
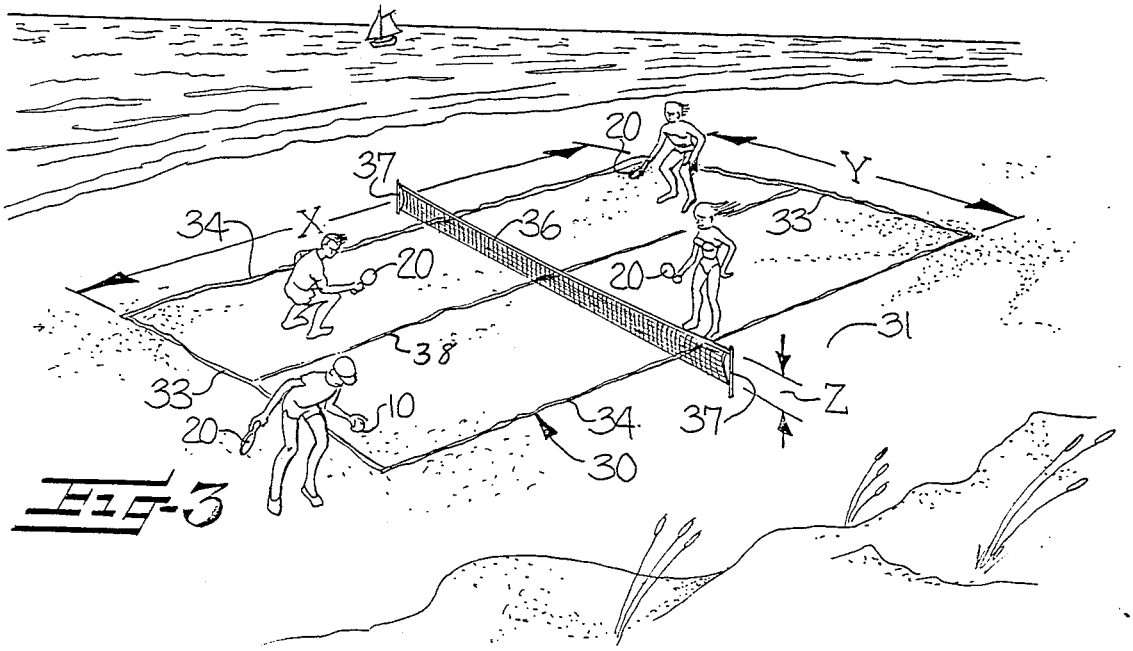
FIG. 3 is a perspective view of a second embodiment of an apparatus of the present invention, adapted for use by two pairs opposing players.

The court may be constructed on any substrate 31 having a smooth, hard surface, including, but not limited to, concrete, asphalt, clay, compact sand, and wood. The playing court comprises a rectangular main court having opposite sides and opposite ends, respectively defining side and end boundaries 32,33. A foul detection means extends transversely from one side of the playing court to the other midway between the end boundaries, and divides the main court into two opposing playing zones 34 of equal size. The rectangular main court is from about seven (7) to thirty (30) feet wide and from about fifteen (15) to forty-five (45) feet long. When the main court is constructed on a sand substrate, as shown in FIG. 3, the side and end boundaries 32,33 may be formed from elongate flexible plastic strips. The strips may be of a color which is easily distinguishable against the sand substrate, such as bright orange. The strips may be held to the substrate with spikes such as 20D nails, which may be driven through the strips at a distance of about five feet from one another.

In a preferred embodiment of the invention, as illustrated in FIG. 1, the foul detector means comprises a rectangular foul zone 35, with the foul zone being from about one (1) inch to ten (10) feet wide. More preferably, the foul zone 35 is from about one (1) foot to about eight (8) feet wide, and is defined by two parallel foul zone boundaries 40,41. Advantageously, a court using such a foul zone can be provided on a substrate such as a gym floor without affecting the suitability of the substraate for other functions and activities. In another embodiment of the present invention, as illustrated in FIG. 3 the foul detector means comprises a vertical net 36. The net is connected to posts 37 at both ends thereof, which posts are secured to the substrate in an upright position outside and adjacent to the rectangular main court. The net is about one-half (½) to two (2) feet high.

A preferred singles court for practicing the invention, as illustrated in FIG. 1, is fifteen (15) feet wide and thirty (30) feet long. The foul zone is preferably about four (4) feet wide. A preferred doubles court, as illustrated in FIG. 3, is about twenty (20) feet wide and thirty (30) feet long. The doubles court preferably has a center line 38 extending medially through the court from one end boundary to the other, and dividing each of the playing zones into a left playing zone and a right playing zone of equal size.

Various courts are illustrated in FIGS. 4 through 8. FIG. 4A illustrates the preferred singles court, about fifteen (15) feet wide (dimension A) by about thirty (30) feet long (dimension B) with about a four (4) foot wide foul zone (dimension C). FIG. 4B illustrates the preferred doubles court about twenty (20) feet wide (A') by about thirty (30) feet long (B') with about a four (4) foot wide foul zone (C').

Figure 5A:
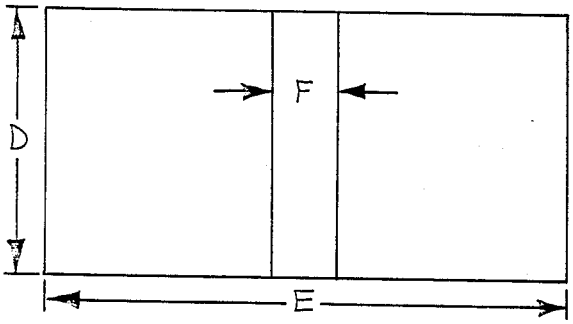
Figure 5B:
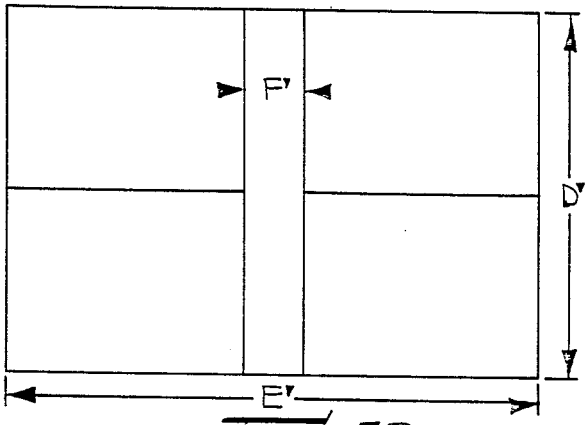

FIG. 5A illustrates an enlarged singles court, about twenty-two (22) feet wide (D) by about forty-four feet long (E) with about a five foot wide net zone (F). FIG. 5B illustrates an enlarged doubles court, about thirty (30) feet wide (D') by about forty-four (44) feet long (E') with about a five (5) foot wide net zone (F').

Figure 6A:
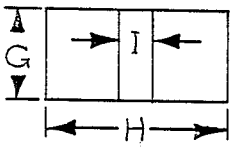
Figure 6B:
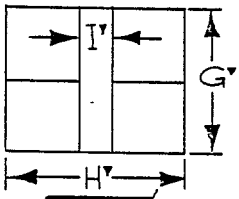

FIG. 6A illustrates a reduced singles court, about seven and one-half (7½) feet wide (G) by about fifteen (15) feet long (H) with about a three foot wide net zone (I). FIG. 6B illustrates a reduced doubles court, about twelve (12) feet wide (G') by about fifteen (15) feet long (H') with about a three (3) foot wide net zone (I').

Figure 4A:
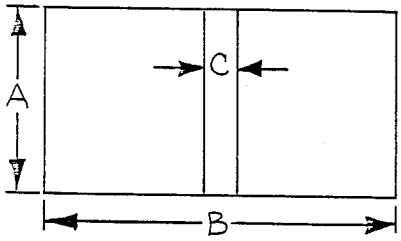
FIGS. 4 through 8 are top plan views of various alternate embodiments of courts of the present invention. The "A" figures illustrate singles courts and the "B" figures illustrate doubles courts.
Figure 4B:
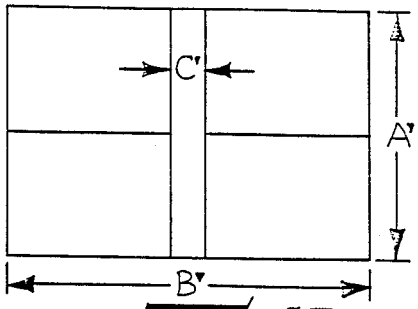
Figure 7A:
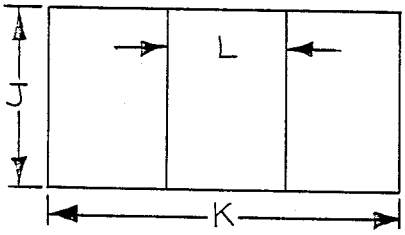
Figure 7B:
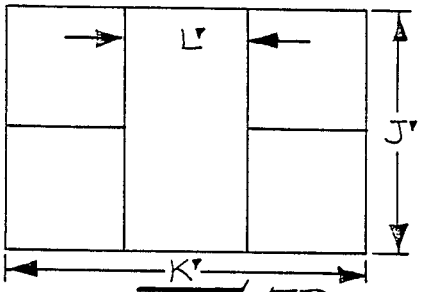
Figure 8A:
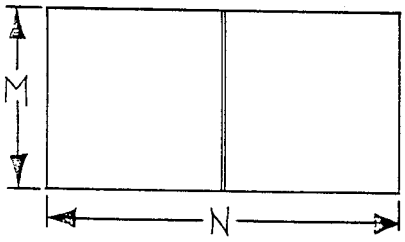
Figure 8B:
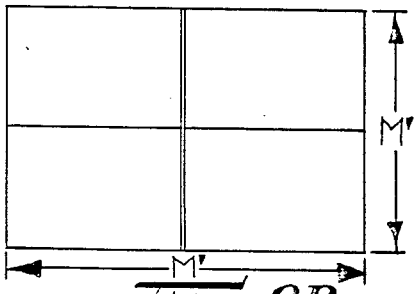

FIG. 7A is similar to FIG. 4A, except that the net zone is enlarged to about ten (10) feet wide (L). FIG. 7B is similar to FIG. 4B, again except that the net zone is enlarged to about ten (10) feet wide (L'). FIG. 8A is similar to FIG. 4A except that the net zone is reduced to about one (1) inch wide, and FIG. 8B is similar to FIG. 4B except that the net zone is reduced to about one (1) inch wide.

Changing the court affects the feel of the game and the exercise derived therefrom. By making the court wider, the lateral movements of the players is increased making it more strenuous, and requiring more foot speed to return the volley. On the other hand, by narrowing the court the lateral movements of the players would be decreased, cutting back on the foot speed and stamina needed. Narrowing the court would, however, increase the hand speed and the hand-eye coordination required to play the game on the smaller court. Somewhat the same results would occur if the length of the court is changed. If made longer, more foot speed is required, if made shorter less foot speed is required. More hand-eye coordination is required on the shorter court.

If the court is scaled up, either as a singles or doubles game, the larger sized court would, adversely, play more and more like tennis as the dimensions of the court increased. Similarly, if the court is scaled down, either as a singles or doubles game, the smaller sized court would, adversely, play more and more like table tennis as the dimensions are decreased. Part of the appeal of the present invention is that when it is played in the dimensions described above, it "feels" like racquet ball and offers a similar degree of exercise and coordination benefit. More preferred dimensions described above provide a game which feels more like racquet ball. Unlike racquet ball, the court cost is very reasonable, as a court of the present invention can be made on any suitable hard flat substrate.

The net zone can be enlaarged or made smaller, as illustrated above. A wider "net" zone would make points harder to score and a narrower "net" zone would make points easier to score. A real net could be substituted for the "net" zone and the height could be varied, as disclosed above. A higher net would make points harder to score, and a lower net would make points easier to score. A net about 1 foot high is preferred when a net is used as the foul detection means.

A suitable set of rules for practicing the present invention are as follows:

1. The server stands outside the main court, toward one backside corner.

2. The first server is determined by a warm-up volley. After the ball has been volleyed 5 times, the player who wins the volley serves first.

3. The server holds the ball in his or her left hand and drops it to the surface. He then must hit the ball on its first bounce over into the playing zone of the opposing player. That player must then, either on the ball's first bounce or before the ball lands on his side, return the ball into the playing zone of the server.

4. A "net" ball loses the point during a volley, or loses the serve if it was hit into the net by the server. If the server initially hits the net, or the out of bounds areas, that is a fault. Two consecutive faults loses the serve.

5. Only the server can score a point. The game is over when the first player reaches 21 points.

6. A player can play in his playing zone or behind the end boundary. The more skillful one becomes, the further back one will tend to play. A preferred court layout includes at least 10' of extra playing room on the substrate behind the end boundaries.

The foregoing rules can be varied according to the preferences of the players. For example, new players tend to prefer to stand in a position behind their end boundary and centered between the side boundaries when serving. Rules similar to those used for tennis, table tennis or racquet ball would also be suitable.

The foregoing examples are illustrative of the present invention rather than restrictive thereof, as the scope of the invention is defined by the following claims. Equivalents of the claims are to be included therein.

That which is claimed is:

1. A court game and apparatus therefor, said apparatus comprising a small resilient ball, at least two paddles having a solid, substantially rigid striking surface, and a playing court, said playing court comprising a rectangular court having opposite sides and opposite ends defining side and end boundaries, respectively, and a rectangular foul zone extending from one side of said playing court to the other midway between said end boundaries and dividing said main court into two opposing playing zones of equal size, wherein said rectangular main court is from about seven (7) to thirty (30) feet wide and from about fifteen (15) to forty-five (45) feet long, and wherein said foul zone is from about one (1) foot to eight (8) feet wide, whereby said players can serve and return said ball to and from one another by striking said ball with said paddles while seeking to avoid striking said ball into said rectangular foul zone.

2. A court game and apparatus as claimed in claim 1, wherein said rectangular main court is about fifteen (15) feet wide and about thirty (30) feet long.

3. A court game and apparatus as claimed in claim 1, further comprising a center line extending medially through said court from one end boundary to the other and dividing each of said playing zones into a left playing zone and a right playing zone, wherein said rectangular main court is about twenty (20) feet wide and about thirty (30) 30 feet long.

4. A court game and apparatus as claimed in claim 2 or 3, wherein said foul zone is about four (4) feet wide.

5. A playing court for use in playing games involving the serving and returning of a resilient ball, comprising a generally flat rectangular main court having opposite sides and opposite ends defining side and end boundaries, respectively, and a relatively narrow rectangular foul zone extending from one of said side boundaries to the other midway between said end boundaries and dividing said main court into two opposing playing zones of equal size, said playing court being formed of a substantially smooth, flat, uninterrupted surface, wherein said rectangular main court is from about seven (7) to thirty (30) feet wide and from about fifteen (15) to forty-five (45) feet long, and said foul zone is from about one (1) foot to eight (8) feet wide.

6. A playing court as claimed in claim 5, wherein said rectangular main court is about fifteen (15) feet wide and about thirty (30) feet long, and said foul zone is about four (4) feet wide.

7. A playing court as claimed in claim 5, wherein said rectangular main court is about twenty (20) feet wide and about thirty (30) feet long, and said foul zone is about four (4) feet wide.

8. A method of playing a ball type court game among at least two players, comprising designating a rectangular main court having opposite sides and opposite ends defining side and end boundaries, respectively, wherein said rectangular main court is from about seven (7) to thirty (30) feet wide and from about fifteen (15) to forty-five (45) feet long, providing a foul zone extending from one side of said playing court to the other midway between said end boundaries and dividing said main court into two opposing playing zones of equal size, wherein said foul zone is from about one (1) foot to eight (8) feet wide, positioning at least one player in each of said playing zones equipping each player with a paddle having a solid, relatively rigid striking surface, equipping one of said players with a small resilient ball, providing a set of rules, and permitting said players to play a game by said rules involving the serving and returning of said ball with said paddles.

9. A method according to claim 8, wherein said rectangular main court is about fifteen (15) feet wide and about thirty (30) feet long.

10. A method of playing a ball type court game among at least two players, comprising designating a rectangular main court having opposite sides and opposite ends defining side and end boundaries, respectively, wherein said rectangular main court is from about seven (7) to thirty (30) feet wide and from about fifteen (15) to forty-five (45) feet long, providing a foul zone extending from one side of said playing curt to the other midway between said end boundaries and dividing said main court into two opposing playing zones of equal size, wherein said foul zone is from about one (1) foot to eight (8) feet wide, positioning at least one player in each of said playing zones, equipping each player with a paddle having a solid, relatively rigid striking surface, equipping one of said players with a small resilient ball, commencing said game by said one player serving said ball to said opposing playing zone with said paddle, continuing said game by respective players in said playing zones alternately returning said ball to said opposing playing zone with said paddle, and scoring said game by detecting said ball landing outside said side and end boundaries, by detecting said ball striking said foul zone, and by detecting said ball bouncing twice within one of said playing zones before being returned by said player positioned in said playing zone.

11. A method according to claim 10, wherein said rectangular main court is about fifteen (15) feet wide and about thirty (30) feet long.

* * * * *